US006072140A

United States Patent [19]

Miller

[11] Patent Number: 6,072,140

[45] Date of Patent: Jun. 6, 2000

[54] METHOD AND APPARATUS FOR ELECTRICALLY CHARGING AND SEPARATING PARTICLES

[76] Inventor: Charles O. Miller, 10162 N. 103 St., Scottsdale, Ariz. 85258

[21] Appl. No.: 09/021,431

[22] Filed: Feb. 10, 1998

[51] Int. Cl.[7] ..... B03C 7/00

[52] U.S. Cl. ..... 209/127.1; 209/127.4; 209/128; 209/129

[58] Field of Search ..... 209/127.1, 127.4, 209/128, 129

[56] References Cited

U.S. PATENT DOCUMENTS

| | | | |
|---|---|---|---|
| 4,100,068 | 7/1978 | Jordan et al. | 209/127.1 |
| 4,341,744 | 7/1982 | Brison et al. | 209/128 |

FOREIGN PATENT DOCUMENTS

| | | | |
|---|---|---|---|
| 0787088 | 12/1980 | U.S.S.R. | 209/127 |
| 1389853 | 4/1988 | U.S.S.R. | 209/129 |
| 1404117 | 6/1988 | U.S.S.R. | 209/129 |

*Primary Examiner*—Donald P. Walsh
*Assistant Examiner*—Daniel K Schlak
*Attorney, Agent, or Firm*—Tod R. Nissle, P.C.

[57] ABSTRACT

A method and apparatus for separating particles provides comingled particles including a first group of particles having a weight and a triboelectric propensity and a second group of particles each having a weight less than the particles in the first group and having a triboelectric propensity greater than that of the particles in the first group. An electric charge is produced to separate the second group of particles from the first group of particles.

7 Claims, 2 Drawing Sheets

FIG. 1 (Prior Art)
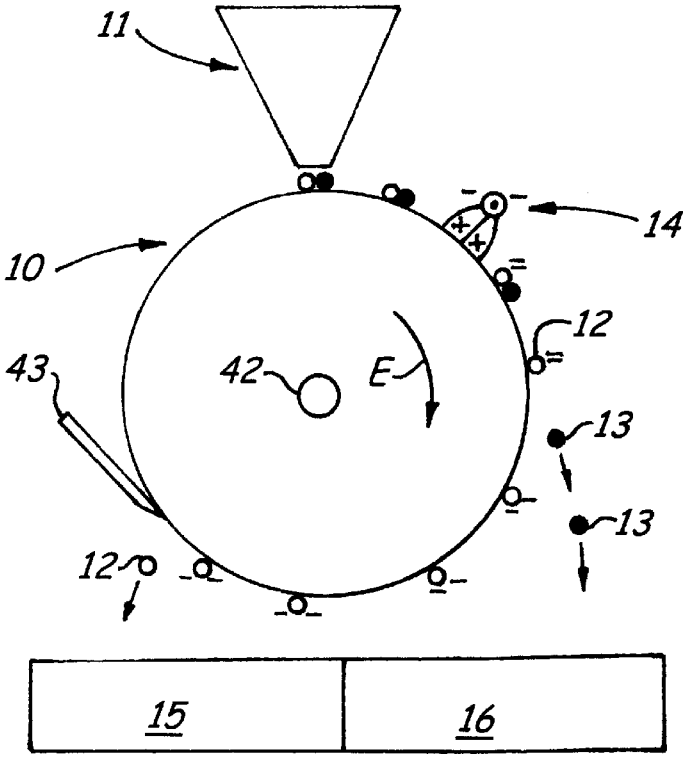
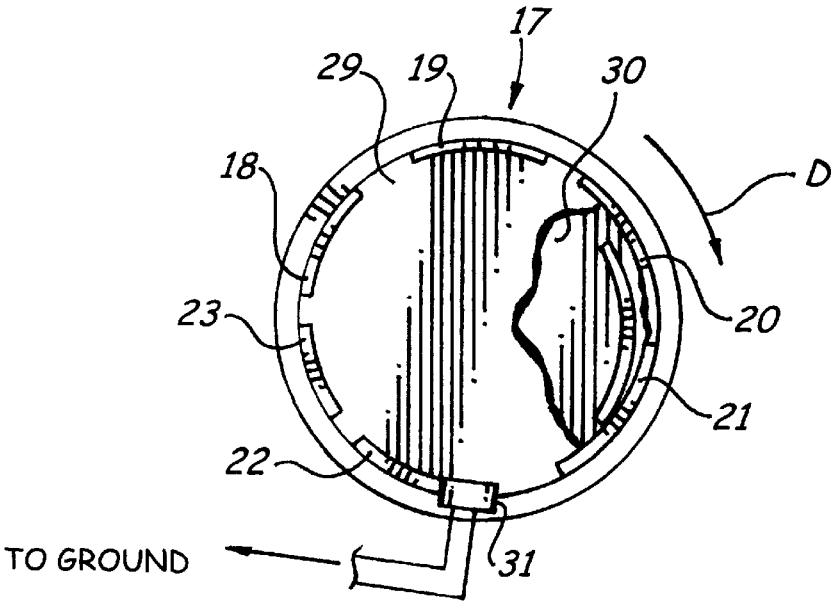
FIG. 3

METHOD AND APPARATUS FOR ELECTRICALLY CHARGING AND SEPARATING PARTICLES

CROSS-REFERENCES TO RELATED APPLICATIONS

None.

STATEMENT REGARDING FEDERALLY SPONSORED RESEARCH OR DEVELOPMENT

None.

REFERENCE TO "MICROFICHE APPENDIX" (SEE 37 CFR 1.96)

None.

BACKGROUND OF THE INVENTION

1. Field of the Invention

This application pertains to a particle separation method and apparatus.

More particularly, the invention relates to an apparatus and method for separating dielectric particles.

In a further respect, the invention relates to particle separation apparatus and method which reduce the risk that a fire or explosion will occur during the separation of particulate.

In another respect, the invention relates to a particle separation apparatus and method which facilitates the separation of elongate fiber strands from a plurality of small substantially round particles.

2. Description of the Related Art Including Information Disclosed Under 37 CFR 1.97 and 1.98

A wide variety of particle separation apparatus is apparently known in the art. One such particle separation apparatus is illustrated in FIG. 1 and includes a cylindrical steel roller 10 which rotates in the direction of arrow E about axle 42. A hopper 11 feeds a mixture of electrically non-conductive 12 and electrically conductive particles 13 onto the cylindrical outer surface or roller 10. The size of the particles is greatly exaggerated for purposes of clarity. The positive side of the power supply is connected to the roller 10. The roller 10 is grounded. An elongate wire 14 is spaced apart from and parallel to the cylindrical surface of roler 10. The wire 14 serves as the negative electrode. A large voltage is directed through wire 14 to produce a corona around the wire. Negative ions move through the field produced by the wire to roller 10. The conductive particles 13 conduct negative ions to roller 10. Consequently, the conductive particles 13 fall off the surface of roller 10 or are thrown off roller 10 into bin 16. In contrast to the conductive particles 13, negative ions are believed to accumulate on the outer surface of each non-conductive particle 12 to cause each particle 12 to be attracted to the positively charged roller 10. The negatively charged non-conductive particles are scrapped off by scraper 43 into bin 15. Several disadvantages are associated with the apparatus of FIG. 1. First, the high voltage required to form a corona around wire 14 increases the risk of explosion or fire during the separation of particulate. Second, while the apparatus of FIG. 1 is well suited for the separation of conductive and non-conductive particles, it ordinarily is not believed well suited for separation of two types of conductive particles (for instance copper and silver particles) or for separation of two types of non-conductive particles (for instance rubber and paper particles).

Accordingly, it would be highly desirable to provide an improved particle separation apparatus and method which would significantly minimize the risk of fire or explosion and which could be utilized to separate dielectric particulate.

Therefore, it is a principal object of the invention to provide an improved method and apparatus for separating particles.

A further object of the invention is to provide an improved method and apparatus for separating dielectric particles.

Another object of the invention is to provide an improved particle separation method and apparatus which minimizes the utilization of energy at levels which increase the risk of fire.

Still a further object of the invention is to provide an improved particle separation method and apparatus which can distinguish between particles of differing size and triboeletric propensity.

BRIEF DESCRIPTION OF THE SEVERAL VIEWS OF THE DRAWINGS

These and other, further and more specific objects and advantages of the invention will be apparent to those skilled in the art from the following detailed description thereof, taken in conjunction with the drawings, in which:

FIG. 1 is an elevation view illustrating a prior art particle separation apparatus;

SUMMARY OF THE INVENTION

Figure 2:
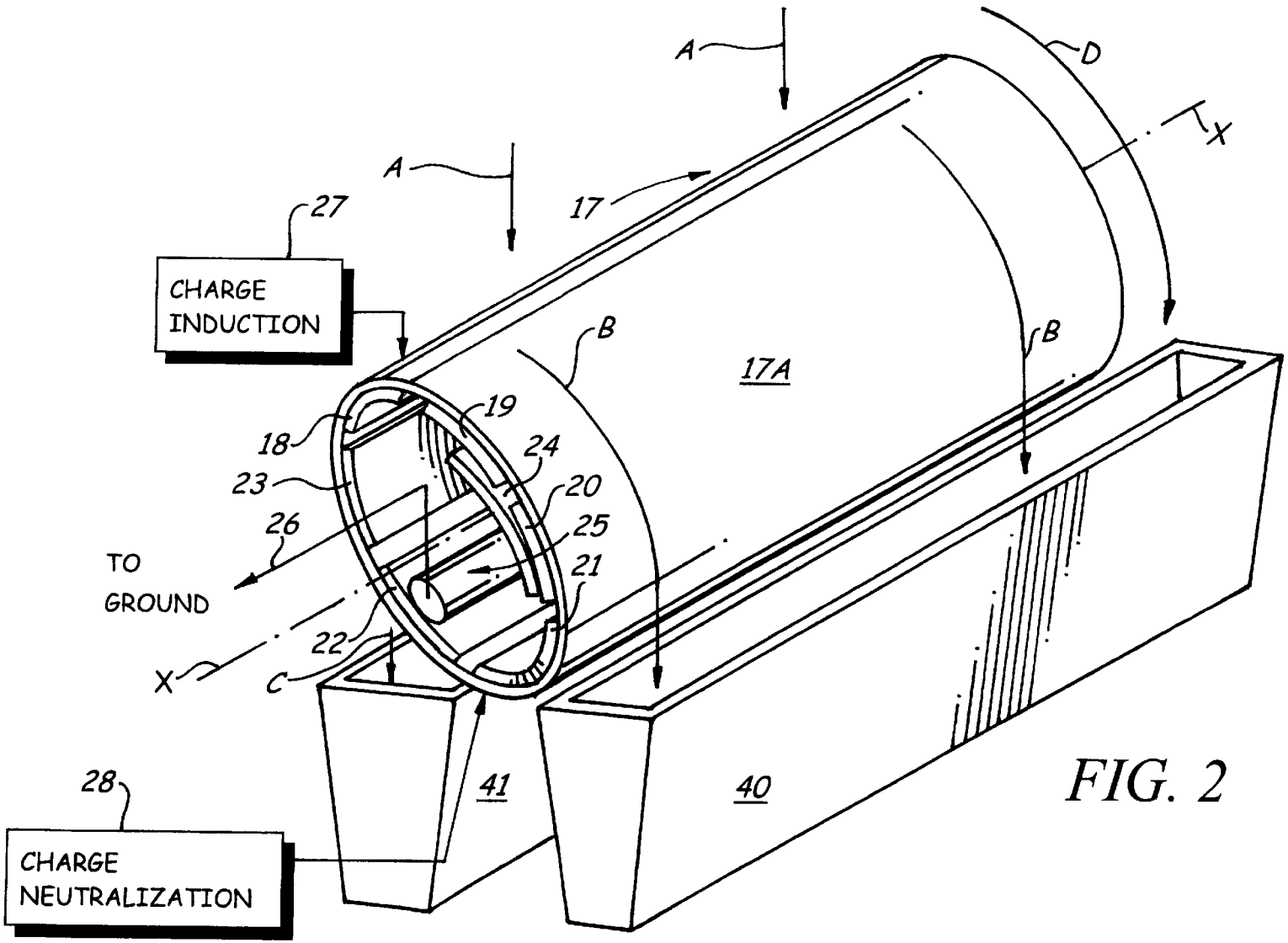
FIG. 2 is a perspective view illustrating particle separation apparatus constructed in accordance with the principles of the invention; and, FIG. 3 is an end view illustrating a roller utilized in an alternate embodiment of the invention.

Briefly, in accordance with my invention, I provide a method for separating particles. The method includes the step of providing comingled particles. The particles include a first group of particles each having a selected weight and triboelectric propensity, and a second group of particles each having a selected weight and triboelectric propensity. The weight of each of the particles in the second group is less than the weight of each of the particles in the first group of particles. The triboelectric propensity of the particles in the second group is greater than the triboelectric propensity of the particles in the first group. The method also includes the steps of electrically charging a surface to attract and hold particles in the second group; contacting the surface with the comingled particles; moving the surface such that the particles in the first group fall off the surface under the force of gravity while the particles in the second group remain on the surface; and, neutralizing the electric charge on the surface such that the particles in the second group can fall off the surface under the force of gravity.

In a further embodiment of the invention, I provide a processing system including comingled particles including a first group of particles each having a selected weight and triboelectric propensity, and a second group of particles each having a selected weight and triboelectric propensity. The weight of each of the particles in the second group is less than the weight of each of the particles in the first group of particles. The triboelectric propensity of the particles in the second group is greater than the triboelectric propensity of the particles in the first group. The processing system also includes a surface; a system for electrically charging at least a portion of the surface to attract and hold particles in the second group; a system for contacting the surface with the comingled particles; a system for moving the surface such that the particles in the first group fall off the surface under the force of gravity while the particles in the second group remain on the surface; a system for neutralizing the electric charge on the surface; and, a system for moving the surface such that the particles in the second group can fall off the surface under the force of gravity.

In another embodiment of the invention, I provide a processing system including comingled particles including a first group of particles and a second group of particles; a surface; a system for electrically charging at least a portion of said surface to create an electrical potential of less than about five volts to attract the second group of particles to the surface; a system for contacting the surface with the comingled particles; a system for moving the surface such that the particles in the first group fall off the surface under the force of gravity while the particles in the second group remain on the surface; a system for neutralizing the electric charge on said surface; and, a system for moving the surface such that the particles in the second group can fall off the surface under the force of gravity.

In still a further embodiment of the invention, I provide a processing system including comingled particles including a first group of particles, and a second group of particles; a particle attracting member having an outer surface; an electrically chargeable member connected to the particle attracting member; a system for frictionally generating an electrical charge in the electrically chargeable member to produce an electrical charge on the outer surface to attract the second group of particles to the outer surface; a system for contacting outer surface with the comingled particles; a system for moving the outer surface such that the particles in the first group fall off the outer surface under the force of gravity while the particles in the second group remain on the outer surface; a system for neutralizing the electric charge on the outer surface; and, a system for moving the outer surface such that the particles in the second group can fall off the outer surface under the force of gravity.

In still another embodiment of the invention, I provide a processing system including comingled particles including a first group of dielectric particles having a dielectric constant, and a second group of dielectric particles having a dielectric constant different from the dielectric constant of the first group of particles; a particle attracting member having an outer surface; an electrically chargeable member connected to the particle attracting member; a system for frictionally generating an electrical charge in the electrically chargeable member to produce an electrical charge on the outer surface to produce attraction an electrical attraction force which attracts the second group of particles to the outer surface more strongly than the first group of particles; a system for contacting the outer surface with the comingled particles; a system for moving the outer surface such that the particles in the first group fall off the outer surface under the force of gravity while the particles in the second group remain on the outer surface; a system for neutralizing the electric charge on the outer surface; and, a system for moving the outer surface such that the particles in the second group can fall off the outer surface under the force of gravity.

In yet still a further embodiment of the invention, I provide a processing system including comingled particles including a first group of dielectric particles having a triboelectric propensity, and a second group of dielectric particles having a triboelectric propensity different from the dielectric constant of said first group of particles; a particle attracting member having an outer surface; an electrically chargeable member connected to the particle attracting member; a system for generating an electrical charge in the electrically chargeable member to produce an electrical charge on the outer surface to produce an electrical attraction force which attracts the second group of particles to the outer surface more strongly than the first group of particles; a system for contacting the outer surface with the comingled particles; a system for moving the outer surface such that the particles in the first group fall off the outer surface under the force of gravity while the particles in the second group remain on the outer surface; a system for neutralizing the electric charge on the outer surface; and, a system for moving the outer surface such that the particles in the second group can fall off the outer surface under the force of gravity.

In yet still another embodiment of the invention, I provide a processing system including comingled particles including a first group of dielectric particles having a dielectric constant, and a second group of dielectric particles having a dielectric constant different from the dielectric constant of the first group of particles; a particle attracting member having an outer surface; an electrically chargeable member connected to the particle attracting member; a system for frictionally generating an electrical charge in the electrically chargeable member to produce an electrical charge on the outer surface to produce an electrical attraction force which attracts the second group of particles to the outer surface more strongly than the first group of particles; a system for contacting the outer surface with the comingled particles; a system for moving the outer surface such that the particles in the first group fall off the outer surface under the force of gravity while the particles in the second group remain on the outer surface; a system for neutralizing the electric charge on the outer surface; and, a system for moving the outer surface such that the particles in the second group can fall off the outer surface under the force of gravity.

DETAILED DESCRIPTION OF THE INVENTION

Turning now to the drawings, which describe the presently preferred embodiments for the purpose of illustrating the structure and use thereof and not by way of limitation of the scope of the invention, and in which like references characters refer to corresponding elements throughout the several views, FIG. 2 illustrates a particle processing system which receives a stream of comingled particles falling under gravity as indicated by arrows A. The comingled particles include at two separate groups of particles. The density, size, shape, electrical conductivity, modulus of elasticity, color, weight, hardness, and other physical properties of each particle and/or group of particles can vary as desired; however, in the presently preferred embodiment of the invention, each group of particles consists of a dielectric. The first group of particles consists of generally spherical rubber particles having a maximum width in the range of about 1/32 to 1/8 of an inch. The second group of particles consists of nylon and/or rayon fibers or lint have a length in the range of about 1/64 to 1/4 of an inch and a width in the range of about 1/128 to 1/32 of an inch. These comingled particles can be produced by grinding automobile and truck tires and using magnets and other filtering apparatus to remove metal cord from the ground material. Each fiber particle in the second group of particles weighs less than each rubber particle in the first group of particles and weighs less than 50%, preferably less than 30%, of the weight of each rubber particle in the first group of particles. The rubber particles comprise 97% to 98.5% of the comingled particles. The nylon and/or rayon fibers comprise 1.5% to 3% by weight of the comingled particles. The comingled particles typically sell at a price of about $40.00 to $70.00 a ton. If, however, the fibers can be separated from the compingled particles the price per ton of the rubber increases very significantly. New butyl rubber sells for about $2,000.00 a ton. If most of the nylon and/or rayon fibers can be removed so that the particle mixture is only ¼% to ½% fibers and is 99.5 to 99.75% by weight rubber particles, then the price of the mixture typically increases from $40.00 to $70.00 per ton to $400.00 to $700.00 a ton. In addition, such a low fiber-particle mixture can be blended in with new rubber to make many products.

Nylon and rayon are each a dielectric. Table I provides the dielectric constant for each of a variety of common dielectrics.

TABLE I

Dielectric Constants for Common Materials

| Dielectric Constant | Material |
|---|---|
| 1.0 | Air |
| 25.0 | Ethyl alcohol |
| 2.5 | Transformer oil |
| 4.5 | Bakelite |
| 2.0 | Beeswax |
| 2.5 | Ebonite |
| 4.5–7.0 | Glass, various kinds |
| 6.0 | Mica |
| 4.1 | Micarta |
| 2.0 | Paper, dry |
| 2.3 | Paraffin |
| 4.0 | Plexiglas |
| 2.5 | Rubber, pure |
| 4.0 | Wood |
| 5.1 | Potassium Chloride |
| 2.7 | Asphalt |
| 4.0 | Iodine |
| 6.6 | Selenium |
| 6.32 | Coming 0010 |
| 3.8 | Silica Glass |
| 2.1 | Teflon |
| 3.8 | Quartz, fixed |
| 3.0 | Paper, Royal grey |
| 2.6 | Polystyrene |
| 5 to 7.5 | Fiber |
| 5 to 7.5 | Formica |
| 5.1 to 5.9 | Porcelain |

The triboelectric propensity of a material is the propensity of a first material to become positively charged (give up electrons to a second material) when the first material is rubbed with the second material. A first material has a greater triboelectric propensity than a second material if the first material gives up electrons to the second material when rubbed by the second material. For example, in Table II, nylon has a greater triboelectric propensity than hard rubber, wood, silk, etc. Glass has a greater triboelectric propensity than nylon.

TABLE II

Triboelectric Series
Any material in this table becomes positively charged (i.e., it gives up electrons) when the material is rubbed with any material lower on the list. The farther apart the materials are on the list the higher the charge will be. Surface conditions and variation in characteristics of some materials may alter some positions slightly.

| |
|---|
| Positive polarity (+) |
| Asbestos |
| Rbitt's fur |
| Glass |

TABLE II-continued

Triboelectric Series
Any material in this table becomes positively charged (i.e., it gives up electrons) when the material is rubbed with any material lower on the list. The farther apart the materials are on the list the higher the charge will be. Surface conditions and variation in characteristics of some materials may alter some positions slightly.

| |
|---|
| Mica |
| Nylon |
| Wool |
| Cat's fur |
| Ca, Mg, Pb |
| Silk |
| Paper |
| Cotton |
| Wood |
| Lucite |
| Sealing wax |
| Cork, Ebony |
| Amber |
| Polystyrene |
| Polyethylene |
| Rubber ballon |
| Resins |
| Cu, Ni, Co, Ag, Sn, As, Bi, Sb, Pd, C, Brass |
| Para Rubber |
| Sulphur |
| Celluloid |
| Hard rubber |
| Vinylite |
| Saran wrap |
| Negative polarity (–) |

The comingled particles fall onto rotating cylinder or drum 17. Drum 17 can be fabricated from any desired material but presently preferably is not a metal in order to minimize the likelihood that a spark may be generated which can cause a fire or explosion. Drum 17 is presently fabricated from a dielectric. Drum 17 is presently preferably PVC (polyvinyl chloride). Elongate generally rectangular metal plates 18 to 23 (presently aluminum) are conformed to and mounted on the inner surface of cylindrical drum in spaced apart parallel relationship. A motor or other means (not shown) are provided for rotating hollow drum 17 about centerline or axis X in the direction indicated by arrow D. Plates 18 to 23 are affixed to and rotate simultaneously with drum 17. A generally rectangular strip 24 of nylon carpet is mounted in a fixed position in which strip 24 is generally parallel to axis X and is positioned such that each metal strip 18 to 23 rubs against strip 24 as the metal strip rotates past strip 24 in the direction indicated by arrow D. When a metal strip 18 to 23 rubs against carpet strip 24, friction results which causes electrons to be transferred from strip 24 onto the strip 18 to 23, producing an electrical potential in strip 18 to 23 which is greater than zero volts and less than about five volts. When a strip 18 to 23 becomes negatively charged, the outer cylindrical surface 17A of drum 17 develops a negative charge. The negatively charged outer surface 17A more strongly attracts and holds the lighter, more triboelectrically sensitive fiber particles than the heavier, less triboelectrically sensitive rubber particles. Less dense particles also tend to be more effectively attacted and held by charged surface 17A than more dense particles of the same size. Consequently, as drum 17 continues to rotate in the direction of arrow D, the heavier, denser, more triboelectrically sensitive rubber particles fall free from surface 17A under the force of gravity (and/or are thrown free) and travel into storage bin 40. In contrast, the lint particles continue to adhere to outer surface 17A until the metal plate 18 to 23 which is immediately beneath such adhering particles contacts metal roller 25. Roller 25 is, as indicated by arrow 26, connected to ground. When a plate 18 to 23 contacts roller 25, the negative charge in roller 25 is completely or substantially discharged, in which case the portion of outer surface 17A immediately above plate 18 to 23 loses most or all of its negative charge, permitting the fibers to fall in the direction of arrow C into bin 41. If desired, means (not shown) can also be provided to scrap off fiber particles in the manner shown in FIG. 1.

After a plate is discharged by contacting roller 25, the plate is again negatively charged when it rotates over carpet 24. This charge-discharge cycle continues for as long as drum 17 continues to rotate and intermittently contact a plate with carpet 24 and roller 25. Any means other than rug 24 can be utilized to generate a negative (or positive) charge on a plate 18 to 23 and/or the outer surface 17A.

One important advantage of the invention is the low voltage required to generate a charge on the outer surface 17A.

Another advantage is the ability to position plates 18 to 23 inside drum 17 to reduce further the danger that a spark generated during the charging or discharged of a plate 18 to 23 could initiate an explosion or fire. As illustrated in FIG. 3, generally circular plates 29, 30 can be placed at either end of drum 17 to further enclose most of plates 18 to 23 and to enclose rug 24 and roller 25. If desired, a metal roller 31 can be provided which rolls over the end of each plate 18 to 23 as it passes by roller 31. Roller 31 is connected to ground to permit each plate 18 to 23 to discharge when it contacts roller 31. Roller 31 continuously rotates in the location shown in FIG. 3 and does not move about axis X with roller 17.

Still another advantage of the processing system of the invention is that it can be utilized to separate two groups of dielectric particles.

Yet another advantage of the processing system of the invention is that separation of two group of dielectric particles is often facilitated by allowing the particles to rub against one another prior to dispensing the particles in the direction of arrow A onto drum 17. Such rubbing of particles can be promoted by directing the particles over a vibrating table which permits the particles to bump and rub against each other while moving the particles to the edge of the table so they fall in the direction of arrows A onto drum 17. Since the fiber particles have a greater triboelectric propensity than the rubber particles, rubbing the fiber particles against the rubber particles tends to produce a positive surface charge on the fiber particles. Positively charging the fiber significantly improves the attraction between the negatively charged drum 17 and the fiber.

Having described the invention in such terms as to enable those skilled in the art to understand and practice it, and having described the presently preferred embodiments thereof, I claim:

1. A method for separating particles including the steps of (a) providing comingled particles including (i) a first group of particles each having a selected weight and triboelectric propensity, and (ii) a second group of particles each having a selected weight and triboelectric propensity, said weight of each of said particles in said second group being less than the weight of each of said particles in said first group of particles, said triboelectric propensity of said particles in said second group being greater than said triboelectric propensity of said particles in said first group;

(b) electrically charging a surface to attract and hold particles in said second group;

(c) contacting said surface with said comingled particles;

(d) moving said surface such that said particles in said first group fall off said surface under the force of gravity while said particles in said second group remain on said surface; and, (e) neutralizing the electric charge on said surface such that said particles in said second group can fall off said surface under the force of gravity.

2. A processing system including (a) comingled particles including (i) a first group of particles each having a selected weight and triboelectric propensity, and (ii) a second group of particles each having a selected weight and triboelectric propensity, said weight of each of said particles in said second group being less than the weight of each of said particles in said first group of particles, said triboelectric propensity of said particles in said second group being greater than said triboelectric propensity of said particles in said first group;

(b) a surface;

(c) means for electrically charging at least a portion of said surface to attract and hold particles in said second group;

(d) means for contacting said surface with said comingled particles;

(e) means for moving said surface such that said particles in said first group fall off said surface under the force of gravity while said particles in said second group remain on said surface;

(f) means for neutralizing the electric charge on said surface; and, (g) means for moving said surface such that said particles in said second group can fall off said surface under the force of gravity.

3. A processing system including (a) comingled particles including (i) a first group of particles, and (ii) a second group of particles;

(b) a surface;

(c) means for electrically charging at least a portion of said surface to create an electrical potential of less than about five volts to attract said second group of particles to said surface;

(d) means for contacting said surface with said comingled particles;

(e) means for moving said surface such that said particles in said first group fall off said surface under the force of gravity while said particles in said second group remain on said surface;

(f) means for neutralizing the electric charge on said surface; and, (g) means for moving said surface such that said particles in said second group can fall off said surface under the force of gravity.

4. A processing system including (a) comingled particles including (i) a first group of particles, and (ii) a second group of particles;

(b) a particle attracting member having an outer surface;

(c) an electrically chargeable member connected to said particle attracting member;

(d) means for frictionally generating an electrical charge in said electrically chargeable member to produce an electrical charge on said outer surface to attract said second group of particles to said outer surface;

(e) means for contacting said outer surface with said comingled particles;

(f) means for moving said outer surface such that said particles in said first group fall off said outer surface under the force of gravity while said particles in said second group remain on said outer surface;

(g) means for neutralizing the electric charge on said outer surface; and, (h) means for moving said outer surface such that said particles in said second group can fall off said outer surface under the force of gravity.

5. A processing system including (a) comingled particles including (i) a first group of dielectric particles having a dielectric constant, and (ii) a second group of dielectric particles having a dielectric constant different from the dielectric constant of said first group of particles;

(b) a particle attracting member having an outer surface;

(c) an electrically chargeable member connected to said particle attracting member;

(d) means for frictionally generating an electrical charge in said electrically chargeable member to produce an electrical charge on said outer surface to produce attraction an electrical attraction force which attracts said second group of particles to said outer surface more strongly than said first group of particles;

(e) means for contacting said outer surface with said comingled particles;

(f) means for moving said outer surface such that said particles in said first group fall off said outer surface under the force of gravity while said particles in said second group remain on said outer surface;

(g) means for neutralizing the electric charge on said outer surface; and, (h) means for moving said outer surface such that said particles in said second group can fall off said outer surface under the force of gravity.

6. A processing system including (a) comingled particles including (i) a first group of dielectric particles having a triboelectric propensity, and (ii) a second group of dielectric particles having a triboelectric propensity different from the dielectric constant of said first group of particles;

(b) a particle attracting member having an outer surface;

(c) an electrically chargeable member connected to said particle attracting member;

(d) means for generating an electrical charge in said electrically chargeable member to produce an electrical charge on said outer surface to produce an electrical attraction force which attracts said second group of particles to said outer surface more strongly than said first group of particles;

(e) means for contacting said outer surface with said comingled particles;

(f) means for moving said outer surface such that said particles in said first group fall off said outer surface under the force of gravity while said particles in said second group remain on said outer surface;

(g) means for neutralizing the electric charge on said outer surface; and, (h) means for moving said outer surface such that said particles in said second group can fall off said outer surface under the force of gravity.

7. A processing system including (a) comingled particles including (i) a first group of dielectric particles having a dielectric constant, and (ii) a second group of dielectric particles having a dielectric constant different from the dielectric constant of said first group of particles;

(b) a particle attracting member having an outer surface;

(c) an electrically chargeable member connected to said particle attracting member;

(d) means for frictionally generating an electrical charge in said electrically chargeable member to produce an electrical charge on said outer surface to produce attraction an electrical attraction force which attracts said second group of particles to said outer surface more strongly than said first group of particles;

(e) means for contacting said outer surface with said comingled particles;

(f) means for moving said outer surface such that said particles in said first group fall off said outer surface under the force of gravity while said particles in said second group remain on said outer surface;

(g) means for neutralizing the electric charge on said outer surface; and, (h) means for moving said outer surface such that said particles in said second group can fall off said outer surface under the force of gravity.

* * * * *